US006893691B2

(12) United States Patent
Fruge et al.

(10) Patent No.: US 6,893,691 B2
(45) **Date of Patent: *May 17, 2005**

(54) COATING COMPOSITION COMPRISING COLLOIDAL SILICA AND GLOSSY INK JET RECORDING SHEETS PREPARED THEREFROM

(75) Inventors: Daniel Ray Fruge, Wilmington, DE (US); Demetrius Michos, Clarksville, MD (US)

(73) Assignee: W. R. Grace & Co.-Conn., Columbia, MD (US)

( * ) Notice: Subject to any disclaimer, the term of this patent is extended or adjusted under 35 U.S.C. 154(b) by 42 days.

This patent is subject to a terminal disclaimer.

(21) Appl. No.: 10/391,287

(22) Filed: Mar. 18, 2003

(65) Prior Publication Data

US 2003/0180483 A1 Sep. 25, 2003

Related U.S. Application Data

(60) Provisional application No. 60/365,587, filed on Mar. 19, 2002.

(51) Int. Cl.[7] ..... B41M 5/40

(52) U.S. Cl. ..... 428/32.33; 428/32.34; 428/32.36

(58) Field of Search ..... 428/32.33, 32.34, 428/32.36, 32.35

(56) References Cited

U.S. PATENT DOCUMENTS

| | | | | |
|---|---|---|---|---|
| 2,244,325 | A | 6/1941 | Bird | 252/313 |
| 2,574,902 | A | 11/1951 | Bechtold | 252/313 |
| 2,577,484 | A | 12/1951 | Rule | 252/313 |
| 2,577,485 | A | 12/1951 | Rule | 252/313 |
| 2,631,134 | A | 3/1953 | Iler | 252/313 |
| 2,750,345 | A | 6/1956 | Alexander | 252/313 |
| 2,773,028 | A | 12/1956 | Monet | 210/8.5 |
| 2,892,797 | A | 6/1959 | Alexander et al. | 252/313 |
| 3,012,972 | A | 12/1961 | Rule | 252/313 |
| 3,969,266 | A | 7/1976 | Iler | 252/313 |
| 5,576,088 | A | 11/1996 | Ogawa et al. | 428/327 |
| 5,756,226 | A * | 5/1998 | Valentini et al. | 428/32.35 |
| 5,966,150 | A * | 10/1999 | Lester et al. | 347/43 |
| 6,086,700 | A * | 7/2000 | Valentini et al. | 156/235 |
| 6,309,709 | B1 * | 10/2001 | Valentini et al. | 427/393.5 |
| 6,497,940 | B1 * | 12/2002 | Valentini et al. | 428/32.25 |
| 2002/0034613 | A1 * | 3/2002 | Liu et al. | 428/195 |
| 2003/0180478 | A1 * | 9/2003 | Fruge et al. | 428/31 |
| 2003/0180480 | A1 * | 9/2003 | Fruge et al. | 428/32.1 |
| 2003/0180483 | A1 * | 9/2003 | Fruge et al. | 428/32.33 |
| 2003/0198759 | A1 * | 10/2003 | Fruge et al. | 428/32.1 |

FOREIGN PATENT DOCUMENTS

| | | | |
|---|---|---|---|
| EP | 0 586 846 | 3/1994 | B41M/5/00 |
| EP | 0 685 344 | 12/1995 | B41M/5/00 |
| EP | 0 759 365 | 2/1997 | B41M/5/00 |
| EP | 1 008 457 | 6/2000 | B41M/5/00 |
| EP | 1 016 546 | 7/2000 | B41M/5/00 |
| WO | 00 20221 | 4/2000 | B41M/5/00 |

OTHER PUBLICATIONS

Types of SNOWTEX. p. 1 of 1.*

G. W. Sears, Jr., Analytical Chemistry, vol. 28, p. 1981 (1956).

* cited by examiner

*Primary Examiner*—B. Shewareged
(74) *Attorney, Agent, or Firm*—William D. Bunch

(57) ABSTRACT

A coating composition comprising a relatively low alkali-containing colloidal silica and glossy ink jet recording sheets prepared from such coatings is described. The coating comprises binder and colloidal silica, e.g., having an average particle size in the range of about 1 to about 300 nanometers. The low alkali colloidal silica of this invention comprises ammonia, polydispersed colloidal silica, or both. Polydispersed silicas having a particle size distribution such that the median particle size is in the range of 15 to 100 nanometers and 80% of the particles span a range of at least about 30 to about 70 nanometers are preferred. It has been discovered that coatings prepared from such colloidal silica and applied to conventional ink jet recording sheet supports have a specular gloss of at least 30 at 60° C., and excellent printability at silica solids to binder solids ratio of 1:1 or greater.

18 Claims, 2 Drawing Sheets

Effect of $SiO_2$/Na ratio on Gloss
Pigment/Binder = 4.0

COATING COMPOSITION COMPRISING COLLOIDAL SILICA AND GLOSSY INK JET RECORDING SHEETS PREPARED THEREFROM

This application claims priority under 35 U.S.C. § 119 of the following provisional application Ser. No(s). 60/365,587 and filing date(s) Mar. 19, 2002.

BACKGROUND OF THE INVENTION

The present invention relates to coated ink jet recording sheets and coating compositions used to prepare the same. In particular, the invention relates to coating compositions suitable for preparing glossy ink jet recording sheets which possess good printability characteristics.

Ink jet printing processes are well known. Such systems project ink droplets onto a recording sheet, e.g., paper, at varying densities and speed. When using multi-color ink jet systems, the process projects in very close proximity a number of different colored inks having varying properties and absorption rates. Indeed, these multi-color systems are designed to provide images which simulate photographic imaging, and such images require high resolution and color gamut. Accordingly, ink jet recording sheets must be able to absorb ink at high densities, in a capacity such that the colors deposited are bright and clear, at rates to effect quick drying, absorb ink so that it does not run or blot, and in a manner that results in smooth images.

To meet these goals, highly porous pigments, e.g., porous silicas, have been incorporated into paper coatings. Such silica-based coating systems have been successful in meeting printability goals. However, it has been difficult to obtain such properties and produce a non-matted, or glossy, finish typically seen in traditional photographic systems. The aforementioned porous pigments typically have porosities above 1 cc/g and have average particle sizes greater than 1 micron. Such particle sizes and porosities increase the surface roughness of the finished coating, thereby deflecting incident light so that it is scattered, thereby matting the coating.

To enhance the glossiness of such coatings, second gloss layers are provided on top of ink receptive layers prepared from the aforementioned porous pigments. These top layers are prepared from binder systems that are inherently glossy, or from layers comprising binder and much smaller sized inorganic oxide particles, e.g., conventional colloidal silica. In the latter approach, the colloidal silica tends to enhance the ink receptive nature of the top coating, but does not have large enough particle size to cause significant surface deformation. There is, however, a tendency for these colloidal particles to agglomerate at high concentrations, thereby causing imperfections and surface roughness in the top layer, and thereby reducing gloss. Accordingly, lower silica concentrations (i.e., lower colloidal solids to binder ratios) have been used when colloidal silica is employed in a top glossy layer.

It has recently been discovered that colloidal silica having relatively low amounts of alkali metal ions, e.g., sodium, does not aggregate in relatively high solids content coating formulations. Deionized colloidal silica is such an example. By "deionized," it is typically meant that any ions, e.g., metal alkali ions such as sodium, have been removed from the colloidal silica solution to an extent such that less than 1000 ppm alkali ions as measured by inductively coupled plasma (ICP) techniques is present in the colloidal silica. Such colloidal silicas are commercially available from W. R. Grace & Co.-Conn. as Ludox® TMA having a pH of 5.0 at 25° C. Coatings prepared from such colloidal silicas are glossy and have printability properties which are acceptable in particular applications. However, they do not have excellent printability properties sought in other segments of the ink jet market.

It would therefore be quite desirable to increase the amounts of solid inorganic oxides in these top layers to further improve printability. Indeed, it would be desirable to use coating layers having at least 1:1 pigment to binder solids ratios, and even more preferable to employ coatings having pigment to binder ratios as high as 4:1 to achieve excellent printability, yet at the same time attain acceptable gloss.

SUMMARY OF INVENTION

Figure 1:
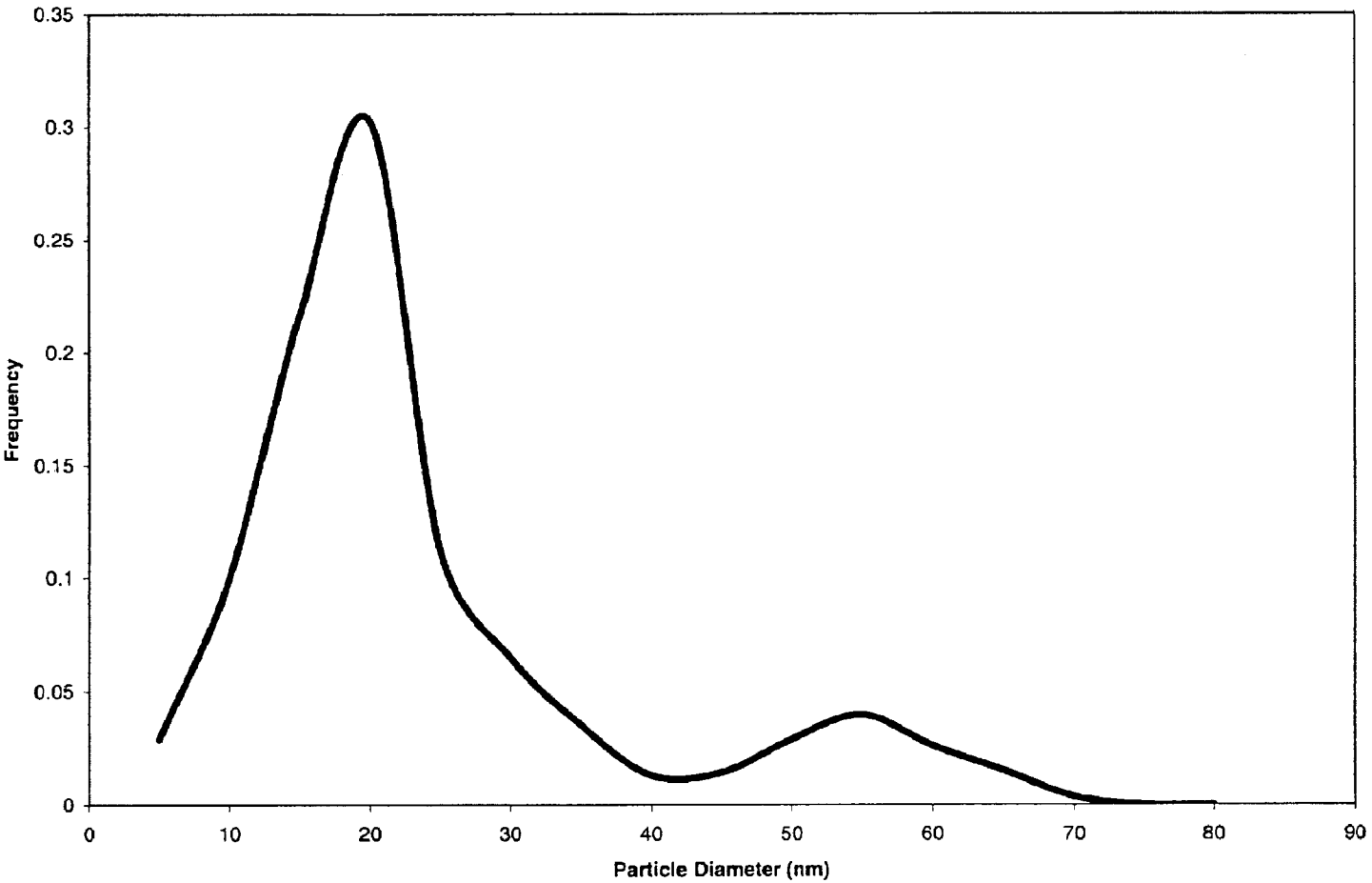
FIG. 1 illustrates the particle size distribution of a polydispersed colloidal silica employed in a preferred embodiment of invention.

The present invention provides an ink jet recording sheet comprising a support and at least one coating layer thereon, said at least one coating layer (a) having a specular surface gloss of at least 30 at 60°, (b) comprising colloidal silica comprising ammonia and having a silica solids to alkali metal ratio of at least the sum of AW(−0.013SSA+9), wherein SSA is the specific surface area of the colloidal silica and AW is the atomic weight of the alkali metal, and (c) binder, wherein the colloidal silica and binder solids are present in the coating at a ratio (b):(c) of at least 1:1 by weight.

Preferably, the ratio of (b):(c) is in the range of about 6:4 to about 4:1.

Preferably, the colloidal silica comprises at least 0.16% by weight ammonia ($NH_3$).

More preferably, the silica solids to alkali metal ratio is at least the sum of −0.30SSA+207, and the alkali metal is sodium.

Preferably, the colloidal silica has a solids to alkali ion ratio of at least 150.

Preferably, the colloidal silica has an average particle size in the range of about 1 to about 300 nanometers.

Another embodiment of this invention is an ink jet recording sheet comprising a support and at least one coating layer thereon, said at least one coating layer (a) having a specular surface gloss of at least 30 at 60°, (b) comprising colloidal silica having a silica solids to alkali metal ratio of at least the sum of AW(−0.013*SSA+9), wherein SSA is the specific surface area of the colloidal silica, and (c) binder, wherein the colloidal silica and binder solids are present at a ratio (b):(c) of at least 1:1 by weight, and wherein the colloidal silica has a particle size distribution such that the median particle size is in the range of 15–100 nm and 80% of the particle sizes span a range of at least about 30 to about 70 nanometers.

Preferably, the colloidal silica of this embodiment further comprises ammonia.

Preferably, the colloidal silica has a silica solids to alkali metal ratio of at least the sum of −0.30(SSA)+207, and the alkali metal is sodium.

Preferably, the colloidal silica has a solids to alkali ion ratio of at least 150.

Also, a goal of this invention is a coating composition comprising (a) colloidal silica having a silica solids to alkali metal ratio of at least the sum of AW(−0.013SSA+9) wherein SSA is the colloidal silica's surface area, and AW is the atomic weight of the alkali metal; and (b) binder wherein (a) and (b) are present at a solids ratio of at least 1:1 by weight, and wherein the colloidal silica has a particle size distribution such that the median particle size is in the range of 15–100 nm and 80% of the particle sizes span a range of at least about 30 to about 70 nanometers.

Preferably, the solids ratio of (a) to (b) is in the range of about 6:4 to about 4:1.

Preferably, the colloidal silica contains at least 0.16% by weight ammonia.

More preferably, the silica solids to alkali ratio is at least the sum of −0.30SSA+207, and the solids to alkali ratio is at least 150.

Another coating composition embodiment of this invention comprises (a) colloidal silica comprising ammonia and a silica solids to alkali ion ratio of at least the sum of AW(−0.013SSA+9) wherein SSA is the colloidal silica's surface area and AW is the atomic weight of the alkali metal; and (b) binder wherein (a) and (b) are present at a solids ratio of at least 1:1 by weight.

It has been discovered that these particular low alkali colloidal silicas not only provide for glossy coatings, but they also provide coatings with good to excellent printability.

DETAILED DESCRIPTION OF THE INVENTION

By the term "colloidal silica" it is meant relatively small silica particles originating from dispersions or sols in which the particles do not settle from dispersion over relatively long periods of time. Colloidal silica having an average particle size in the range of about 1 to about 300 nanometers and processes for making the same are well known in the art. See U.S. Pat. Nos. 2,244,325; 2,574,902; 2,577,484; 2,577,485; 2,631,134; 2,750,345; 2,892,797; and 3,012,972. Colloidal silicas having average particle sizes in the range of 5 to 100 nanometers are more preferred and generally preferred for this invention. The surface area of colloidal silicas (as measured by BET) can be in the range of 9 to about 2700 $m^2/g$. Commercially available colloidal silicas vary in silica content from about 20% to about 50% weight silica.

Most colloidal silica sols contain an alkali. The alkali is usually an alkali metal hydroxide from Group IA of the Periodic Table (hydroxides of lithium, sodium, potassium, etc.). Most commercially available colloidal silica sols contain sodium hydroxide, which originates, at least partially, from the sodium silicate used to make the colloidal silica, although sodium hydroxide may also be added to stabilize the sol against gelation.

Figure 2:
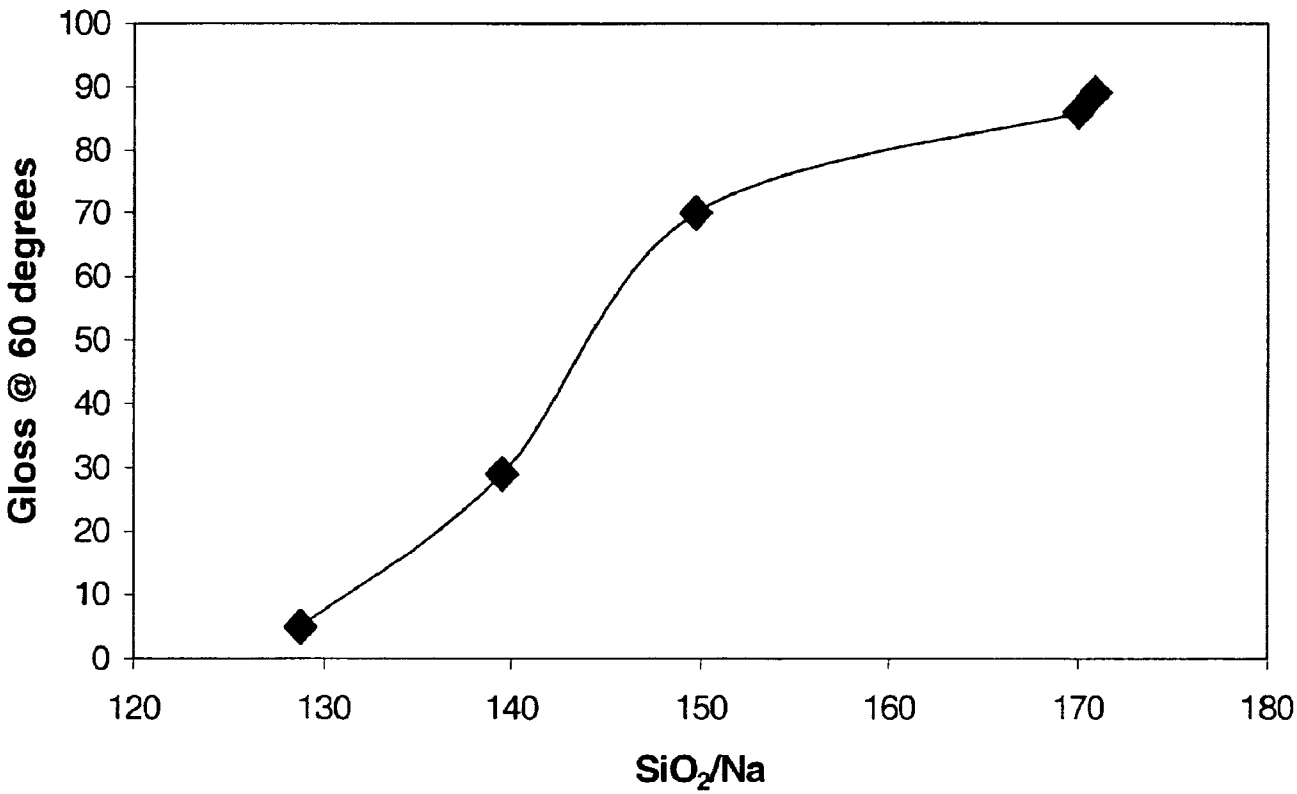
FIG. 2 illustrates a colloidal silica's silica solids to alkali metal ratio versus gloss achieved from coatings containing the same.

The colloidal silica sols of this invention have significantly lower levels of alkali metal ions than most commercially available colloidal silica sols. This can be illustrated by calculating the silica solids to sodium weight ratios of the colloidal silica sol, as shown in Equation 1. FIG. 2 shows that acceptable gloss can be obtained from the colloidal silica sols using the equation below:

$$SiO_2/\text{Alkali Metal} \geq AW(-0.013*SSA+9) \qquad \text{Equation 1.}$$

The $SiO_2$/alkali metal is the weight ratio of silica solids and alkali metal in the colloidal silica sol. AW is the atomic weight of the alkali metal, e.g., 6.9 for lithium, 23 for sodium, and 39 for potassium, and SSA is the specific surface area of the colloidal silica particles in units of square meters per gram ($m^2/g$). When the alkali metal is sodium, the $SiO_2$/Alkali Metal ratio is at least the sum of −0.30SSA+207.

The silica solids to alkali metal ratios of deionized colloidal silica sols fall within this range and are suitable for this invention. By "deionized," it is meant that any metal ions, e.g., alkali metal ions such as sodium, have been removed from the colloidal silica solution to an extent such that the colloidal silica has a silica solids to alkali metal ratio referred to in Equation 1. Methods to remove alkali metal ions are well known and include ion exchange with a suitable ion exchange resin (U.S. Pat. Nos. 2,577,484 and 2,577,485), dialysis (U.S. Pat. No. 2,773,028) and electrodialysis (U.S. Pat. No. 3,969,266).

As indicated above, one embodiment of this invention comprises ammonia. Ammonia-containing colloidal silica and methods for making the same are known in the art. See Ralph K. Iler's *The Chemistry of Silica*, John Wiley & Sons, New York (1979) pages 337–338. Briefly, a sodium containing colloidal silica is prepared using conventional conditions. Residual sodium ions are then exchanged with a base, e.g., ammonium ions. Typical ammonia containing embodiments contain at least 0.01 weight %, and preferably 0.05 to 0.20% by weight ammonia wherein ammonia content is measured per the technique described later below. Ammonia-containing colloidal silica is commercially available as Ludox® AS-40, from W. R. Grace & Co.-Conn. Certain commercially available colloidal silicas containing ammonia have suitable solids to alkali ratios and would be suitable as is. Other embodiments can be prepared by deionizing a colloidal silica having higher alkali content and subsequently adding ammonia.

Another deionized colloidal silica suitable for this invention is what is known as polydispersed colloidal silica. "Polydispersed" is defined herein as meaning a dispersion of particles having a particle size distribution in which the median particle size is in the range of 15–100 nm and which has a relatively large distribution span. Preferred distributions are such that 80% of the particles span a size range of at least 30 nanometers and can span up to 70 nanometers. The 80% range is measured by subtracting the $d_{10}$ particle size from the $d_{90}$ particle size generated using TEM-based particle size measurement methodologies described later below. This range is also referred to as the "80% span." One embodiment of polydispersed particles has particle size distributions which are skewed to sizes smaller than the median particle size. As a result, the distribution has a peak in that area of the distribution and a "tail" of particle sizes which are larger than the median. See FIG. 1. The lower and upper particle size of the span encompassing 80% of the particles can be −11% to −70% and 110% to 160% of the median, respectively. A particularly suitable polydispersed silica has a median particle size in the range of 20 to 30 nanometers and 80% of the particles are between 10 and 50 nanometers in size, i.e., 80% of the distribution has a span of 40 nanometers. This embodiment can be prepared by deionizing commercially available polydispersed silicas according to techniques described earlier.

Deionized polydispersed silicas which further contain ammonia are also suitable. Ammonia can be added to a deionized polydispersed silica according to earlier described techniques.

The coating binders mentioned above can be those typically used to make paper coatings. The binder not only binds the colloidal silica to form a film, but it also provides adhesiveness to the interface between the gloss-providing layer and the substrate or any intermediate ink-receiving layer between the glossy layer and substrate.

Water-soluble binders are suitable in the present invention and may, for example, be a starch derivative such as oxidized starch, a etherified starch or phosphate starch; a cellulose derivative such as carboxymethyl cellulose or hydroxymethyl cellulose; casein, gelatin, soybean protein, polyvinyl alcohol or a derivative thereof; polyvinyl pyrrolidone, a maleic anhydride resin or a conjugated diene-type copolymer latex such as a styrene-butadiene copolymer or a methyl methacrylate-butadiene copolymer; acrylic polymer latex such as a polymer or copolymer of an acrylic acid ester or a methacrylic acid ester; a vinyl-type polymer latex such as an ethylene-vinyl acetate copolymer; a functional group-modified polymer latex of such a various polymer with a monomer containing a functional group such as a carboxyl group. An aqueous adhesive such as a thermosetting synthetic resin such as a melamine resin or a urea resin; a polymer or copolymer resin of an acrylic acid ester or a methacrylic acid ester such as a polymethyl methacrylate; or a synthetic resin-type binder such as a polyurethane resin, an unsaturated polyester resin, a vinyl chloride-vinyl acetate copolymer, polyvinyl butyral or an alkyd resin may also be used. Water insoluble binders in latex form are also suitable.

The binder can be combined with the colloidal silica using conventional blenders and mixers. The components can be combined and mixed at ambient conditions.

As mentioned earlier, it is desirable for the colloidal silica and binder to be present in the coating at relatively high ratios. It is particularly desirable for the colloidal silica and binder solids to be present at a ratio of at least 1:1, and more preferably 6:4 to 4:1 by weight. The ratio can be as high as 9.9:1. It has been found that higher silica to binder ratios enhance the printability of coatings, as well as provides advantageous mechanical properties to the finished ink receptive coating sheet.

It may also be desirable to include additional components in the coating composition of this invention. The coating of this invention can contain one or more of the following: dispersant, thickener, fluidity-improving agent, defoaming agent, foam-suppressing agent, release agent, blowing agent, penetrating agent, coloring dye, coloring pigment, fluorescent brightener, ultraviolet absorber, anti-oxidant, preservative, ash-preventing agent, waterproofing agent, and wet-strength agent.

A portion of the ammonia-containing or polydispersed colloidal silica also can be replaced by one or more other colloidal materials, provided the total amount of alkali ion present in the combination of colloidal materials does not rise to a level such that the silica solids to alkali metal ratio is less than the sum of AW(−0.013*SSA+9), and the amount of the additional colloidal material does not detract from the overall gloss and/or printability desired for the finished coating. These other colloidal materials not only include colloidal silica, but also titania, zirconia, and the like. Such additional inorganic oxide colloidal particles could from time to time be added as a filler.

The coatings of this invention have been shown to have a gloss of at least thirty (30) at 60° according to a BYK Gardner measuring instrument. Preferable coatings according to this invention have a gloss of at least 40, and more preferably at least 80 at a 6:4 pigment to binder ratio; and at least 50, and preferably at least 70 at a 4:1 pigment to binder ratio. Coatings of this invention have been shown to have a gloss of at least 90 at a 4:1 pigment to binder ratio.

Suitable supports for preparing the ink recording sheet of this invention can be those typically used in the art. Suitable supports include those having a weight in the range of about 40 to about 300 g/m$^2$. The support may be base paper produced from a variety of processes and machines such as a Fourdrinier paper machine, a cylinder paper machine or a twin wire paper machine. The supports are prepared by mixing its main components, i.e., a conventional pigment and a wood pulp including, for example, a chemical pulp, a mechanical pulp, and/or a waste paper pulp, with various additives including a binder, a sizing agent, a fixing agent, a yield-improving agent, a cationic agent and a strength-increasing agent. Other supports include transparent substrates, fabrics and the like.

Further, the support may also be size-pressed paper sheets prepared using starch or polyvinyl alcohol. The support can also be one which has an anchor coat layer thereon, e.g., paper already having a preliminary coating layer provided on a base paper. The base paper may also have an ink-receiving layer applied prior to applying the coating of this invention.

Coatings comprising colloidal silica, binder and optional additives can be applied online as the support is being prepared, or offline after the support has been finished. The coating can be applied using conventional coating techniques, such as air knife coating, roll coating, blade coating, bar coating, curtain coating, die coating, and processes using metered size presses. The resulting coatings can be dried by ambient room temperature, hot air drying methods, heated surface contact drying or radiation drying. Typically, the coating composition of the invention, and any optional intermediate layers, is applied in a range of 1 to 50 g/m$^2$, but more typically in the range of 2 to 20 g/m$^2$.

The examples below show that a glossy ink jet recording sheet having good printability is prepared essentially from a support and one layer of the invention. However, it may be desirable in certain instances to place another layer, which is ink receptive, between the gloss providing layer of the invention and the support to enhance the printability of the final sheet.

Suitable ink receptive layers are those identified as such in U.S. Pat. No. 5,576,088, the contents of which are incorporated herein by reference. Briefly, suitable ink receptive layers comprise a binder such as the water soluble binders listed above, and an ink receptive pigment. Such pigments include a white inorganic pigment such as light calcium carbonate, heavy calcium carbonate, magnesium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, alumina, colloidal alumina, pseudo boehmite, aluminum hydroxide, lithopone, zeolite, hydrolyzed halloysite or magnesium hydroxide, or an organic pigment such as a styrene-type plastic pigment, an acrylic plastic pigment, polyethylene, microcapsules, a urea resin or a melamine resin. Suitable pigments for the ink receptive layer have average particle sizes (measured by light scattering techniques) in the range of 0.5 to 3.0 microns and pore volumes ranging from 0.5 to 3.0 cc/g and preferably pore volumes of 1.0 to 2.0 cc/g, as measured by nitrogen porosimetry. In order to obtain an ink jet recording sheet having a high ink absorptivity, it is preferred that the pigment in the ink-receiving layer contains at least 30 vol. % of particles having a particle size of at least 1.0 $\mu$m.

The preferred embodiments, and modes of operation of the present invention have been described in the foregoing specification. The invention which is intended to be protected herein, however, is not to be construed as limited to the particular embodiments disclosed, since they are to be regarded as illustrative rather than restrictive. Variations and changes, therefore, may be made by those skilled in the art without departing from the spirit of this invention.

Further, any range of numbers recited in the specification or claims, such as that representing a particular set of properties, conditions, physical states or percentages, is intended to literally incorporate expressly herein any number falling within such range, including any subset ranges of numbers within any range so recited.

ILLUSTRATIVE EXAMPLES

The parameters listed below and/or indicated earlier were measured as follows:

- Average Particle Size—unless indicated otherwise, is a number average particle size determined by the equation $d_n$=3100/SSA, wherein $d_n$ is the number average particle size in nanometers and SSA is the specific surface area described below.
- Median Particle Size—is a number weighted median measured by electron microscopy (TEM).
- Gloss—measured using a BYK Gardner micro-TRI-gloss instrument which has been calibrated on a transparent polyester film. As indicated below, the gloss values were measured from a reflection angle of 60°.
- Alkali metal (e.g., Na) Content—based on alkali metal ion content measured using the inductively coupled plasma-atomic emission (ICP-AES) spectroscopy technique. The sample is first dissolved at ambient conditions, e.g., 25° C. and 75% relative humidity, in hydrofluoric acid and nitric acid (at a 30/70 weight ratio) before applying this technique. The sample was allowed to dissolve for sixteen hours before measurements were taken.
- Silica Solids Content—measured in an Ohaus furnace at 205° C., with the end point for the solids measurement being when the sample weight change is less than 0.01 g for sixty (60) seconds
- Specific Surface Area—titrimetric method correlated to surface area by nitrogen adsorption as given by G. W. Sears, Jr., Analytical Chemistry, Vol. 28, p. 1981, (1956).
- Printability (or print quality)—is evaluated by observing the appearance of the green, blue and red colored blocks in a printed image prepared on an Epson Stylus 900 color printer after drying the coating using a stream of warm air at 37° C. The methodology for making these observations is as follows:
  - Color uniformity and bleed were evaluated for each of the colors. The combined rating for the two evaluations is as follows:
  - Excellent=All colors appear uniform and there is no bleeding outside the print area.
  - Good=Colors are not completely uniform and bleed occurs in at least one of the color blocks.
  - Poor=Colors appear non-uniform and ink puddling occurs for at least one color; there also is severe bleeding.
- Ammonia Content—determined by conventional titration techniques using hydrochloric acid.

EXAMPLES

Example 1 (Comparison)

A polydispersed colloidal silica (6.40 g; 50 wt % solids, median particle size of 22 nanometers and 80% particle span of about 40 nanometers) having a specific surface area of 70 $m^2/g$ and silica solids to sodium ratio of 179 was placed in beaker and diluted with 9.49 g of DI water. To that 5.16 g of Airvol-523 polyvinyl alcohol (15.5 wt % solution) from Air Products were added. The mixture was blended with ambient conditions. The resulting formulation was coated as a 100 micron wet film on polyester film* using a TMI coater (K control coater), using a number 8 rod. The coatings were dried and measured for gloss. The obtained coating had a gloss of 3% at 60 degrees. The same components were similarly combined to make coatings at a variety of other pigment to binder ratios, and then dried and measured for gloss. Those measurements also appear in Table 1. This result would be expected based on Equation 1 indicating that the $SiO_2$/Na ratio should be at least 186 to obtain acceptable gloss.

* Formulation Coated on Melinex (TM)-534 polyester, opaque white flim. from E.I. DuPont de Nemours & Co.

Example 2

The polydispersed silica of Example 1 was deionized with a cation exchange resin to pH 3.0–3.5. Ammonium hydroxide was added to the colloidal silica sol until pH 9.1 was reached and the sol was adjusted with deionized water to make a sol containing 40% silica. The resulting silica had a solids to sodium ion ratio of 308. 10.0 g of this sol were placed in a beaker and diluted with 9.86 g of DI water. To that 6.45 gof Airvol-523 (15.5 wt % solution) were added. The resulting formulation was coated and dried on polyester film. The resulting coating had a gloss of 76% at 60 degrees. The same components were similarly combined to prepare coatings at a variety of pigment to binder ratios, and the coatings were measured for gloss. Those measurements also appear in Table 1.

Example 3

The polydispersed colloidal silica of Example 1 was aluminum stabilized using a method similar to U.S. Pat. No. 2,892,797, the contents of which are incorporated by reference. The resulting colloidal silica sol was then deionized to pH 3.0–3.5 and adjusted with deionized water to make a sol containing 40% silica. This colloidal silica had a SSA=70 $m^2/g$ and $SiO_2$/Alkali ratio of 308 10.0 g of this sol were placed in a beaker and diluted with 9.86 g of DI water. To that 6.45 g of Airvol-523 (15.5 wt % solution) were added. The resulting formulation was coated and dried on polyester film. The obtained coating had a gloss of 51% at 60 degrees. The same components were similarly combined at a variety of other pigment to binder ratios, with coatings therefrom measured for gloss. Those measurements also appear in Table 1.

Example 4 (Comparison)

Ludox® HS-40 (7.77 g; 40 wt % solids) having a silica solids to sodium ion ratio of 131 and a specific surface area of 220 $m^2/g$ was placed in beaker and diluted with 11.4 g of DI water. To that 6.67 g of Airvol-523 (15.5 wt % solution) were added. The resulting formulation was coated on polyester film. The obtained coating had a gloss of 3% at 60 degrees. The same components were similarly combined at a variety of other pigment to binder ratios, with coatings therefore again measured for gloss. Those measurements also appear in Table 1. This result would be expected based on Equation 1 indicating that the $SiO_2$/Na ratio should be at least 141 to obtain acceptable gloss.

Example 5

7.777 g of Ludox® AS-40 (ammonia content of 0.16%) having a SSA=135 and a silica solids to sodium ion ratio of 674 were placed in a beaker and diluted with 7.668 g of DI water. To that 4.960 g of Airvol-523 (15.5 wt % solution) were added. The resulting formulation was coated on polyester film. The obtained coating had a gloss of 90% at 60.

Example 6 (Comparison)

Ludox® TMA (34 wt % solids) having a specific surface area of 140 $m^2/g$ and a silicas solids to sodium ion ratio of 572 was diluted to 15 wt % solids. 13.33 g of this solution was mixed with 4.3 g of Airvol-523 (15.5 wt % solution). The resulting formulation was coated on polyester film. The obtained coating had a gloss of 85% at 60 degrees. This result would be expected based on Equation 1 indicating that the $SiO_2$/Na ratio should be at least 165 to obtain acceptable gloss.

Example 7 (Comparison)

Ludox® SM (13.70 g; 30 wt. % solids) having specific surface area of 345 $m^2/g$ and a silica solids to sodium ion ratio of 72 was placed in a beaker and diluted with 6.71 g of deionized water. To that, 6.63 g of Airvol-523 (15.5 wt. % solution) were added. The resulting formulation was coated on polyester film. The obtained coating had a gloss of 3% at 60 degrees. This relatively low gloss is consistent with Equation 1, which indicates that $SiO_2$/Na must be $\geqq 104$ for acceptable gloss.

Example 8

The polydispersed colloidal silica of Example 1 (30 g; 50 wt. % solids) was placed in a beaker. Amberlite® 120 (plus) ion exchange resin, a product of Rohm & Haas, (hydrogen form) was slowly added, with agitation, until the pH of the colloidal silica was lowered to pH=2.6. This pH was maintained for 1 hour by the addition of small amounts of ion-exchange resin. Then, the resin was separated from the colloidal silica via filtration. 6.01 g of the above prepared material (50 wt. % solids) having a silica solids to sodium ion ratio of 333 was placed in a beaker and diluted with 11.21 g of deionized water. To that, 4.84 g of Airvol-523 (15.5 wt. % solution) were added. The resulting formulation was coated on polyester film. The obtained coating had a gloss of 76% at 60 degrees. This high gloss is consistent with Equation 1, which indicates that $SiO_2$/Na must be $\geqq 186$ for acceptable gloss. This Example also indicates that ammonia favorably affects the printability obtained using the invention when the results are compared against those in Example 2 in which excellent printability results were obtained from an ammonia-containing colloidal silica.

Example 9

Ludox® HS-40 (30 g; 40 wt. % solids) colloidal silica having specific surface area of 220 $m^2/g$ and silica solids to sodium ion ratio of 131 was placed in a beaker. Amberlite® 120 (plus) ion exchange resin, a product of Rohm & Haas, (hydrogen form) was slowly added, with agitation, until the pH of the colloidal silica was lowered to pH=2.6. This pH was maintained for 1 hour by the addition of small amounts of ion-exchange resin. Then, the resin was separated from the colloidal silica via filtration. 7.51 g of the above prepared material (40 wt. % solids) having a silica solids to sodium ion ratio of 388 was placed in a beaker and diluted with 9.76 g of deionized water. To that, 4.90 g of Airvol-523 (15.5 wt. % solution) were added. The resulting formulation was coated on polyester film. The obtained coating had a gloss of 72% at 60 degrees. This gloss is consistent with Equation 1, which indicates that $SiO_2$/Na must be $\geqq 141$ for acceptable gloss.

Example 10 (Comparison)

The pH of the polydispersed silica of Example 1 was raised to pH=10.5 using a 1 wt. % ammonia solution. 7.96 g of the above prepared material was placed in a beaker and diluted with 9.26 g of deionized water. To that, 4.84 g of Airvol-523 (15.5 wt. % solution) were added. The resulting formulation was coated and dried on polyester film. The obtained coating had a gloss of 6% at 60 degrees. This indicates deionization rather than ammonia affects the invention's performance with respect to glossiness.

TABLE 1

| | Content or Ratio by Weight | | | Gloss at Various Colloidal Silica to Binder Solids | | | | | Printability |
|---|---|---|---|---|---|---|---|---|---|
| Example | % $SiO_2$ | % Na | $SiO_2$/Na | 1:4 | 4:6 | 6:4 | 7:3 | 4:1 | @ 4:1 |
| 1(Comparison) | 50[1] | 0.28 | 179 | 92 | 89 | 32 | ~ | 3 | ~ |
| 2 | 40[2] | 0.130 | 308 | ~ | 81 | 84 | 80 | 76 | Excellent |
| 3(Comparison) | 40[3] | 0.130 | 308 | ~ | ~ | ~ | 73 | 51 | Good |
| 4(Comparison) | 40[4] | 0.304 | 131 | 95 | 71 | 8 | ~ | 3 | ~ |
| 5 | 40[5] | 0.0594 | 674 | 92 | 94 | 92 | 92 | 90 | Good |
| 6(Comparison) | 34[6] | 0.0594 | 572 | ~ | ~ | ~ | 88 | 85 | Poor |
| 7(Comparison) | 30 | 0.415 | 72 | ~ | ~ | 3 | ~ | 3 | ~ |
| 8 | 50 | 0.150 | 333 | ~ | ~ | 77 | ~ | 76 | Good |
| 9(Comparison) | 40 | 0.103 | 388 | ~ | ~ | 75 | ~ | 72 | Poor |
| 10(Comparison) | 50 | 0.26 | 179 | ~ | ~ | ~ | ~ | 6 | ~ |

~ indicates measurement was not made
[1]Median Particle Size is 22 nm; SSA = 70 $m^2/g$
[2]Median Particle Size is 22 nm; SSA = 70 $m^2/g$
[3]Median Particle Size is 22 nm; SSA = 70 $m^2/g$
[4]Average Particle Size is 12 nm; SSA = 220 $m^2/g$
[5]Average Particle Size is 22 nm; SSA = 135 $m^2/g$
[6]Average Particle Size is 22 nm
Printability: Relative Rating Based on the appearance of Green, Blue and Red Colors; Epson 900 Printer Example 11

Ludox® HS-40 was deionized to pH=3.0–3.5 using the hydrogen form of Amberlite® 120 plus ion exchange resin, a product of Rohm & Haas. Then NaOH were added in amounts indicated below in Table 2. 1% $NH_4OH$ was added to a final pH of 9.1. Coatings were then prepared in a manner similar to that described in the earlier examples wherein each of the solids ratio was 80/20=pigment/Airvol-523 (P/B=4.0). The sodium ion content, $SiO_2$ solids content and $Na_2O$ were also measured for each sample of deionized and/or NaOH modified colloidal silica. The results and the resulting solids content to alkali metal ion ratio are reported in Table 2 below. These ratios versus gloss are illustrated graphically in FIG. 2. The gloss values reported in Table 2 and the Figure were measured at 60°.

TABLE 2

| NaOH (g) | Gloss | % Na | % $SiO_2$ | $SiO_2$/Na | % $Na_2O$ |
|---|---|---|---|---|---|
| 0 | 88 | ~ | ~ | ~ | ~ |
| 0.8 | 87 | ~ | ~ | ~ | ~ |
| 1.61 | 89 | ~ | ~ | ~ | ~ |
| 3.23 | 90 | ~ | ~ | ~ | ~ |
| 4.84 | 91 | ~ | ~ | ~ | ~ |
| 6.46 | 91 | ~ | ~ | ~ | ~ |
| 8.07 | 89 | 0.141 | 24.1 | 170.9 | 0.190 |
| 9.10 | 86 | 0.150 | 25.5 | 170.0 | 0.202 |
| 10.02 | 70 | 0.157 | 23.5 | 149.7 | 0.212 |
| 11.73 | 29 | 0.167 | 23.3 | 139.5 | 0.225 |
| 13.44 | 5 | 0.180 | 23.2 | 128.8 | 0.243 |

What is claimed:

1. An ink jet recording sheet comprising a support and at least one coating layer thereon, said at least one coating layer (a) having a specular surface gloss of at least 30 at 60°, (b) comprising colloidal silica comprising ammonia and having a silica solids to alkali metal ratio of at least the sum of AW(−0.013SSA+9), wherein SSA is the specific surface area of the colloidal silica and AW is the atomic weight of the alkali metal, and (c) binder, wherein the colloidal silica and binder solids are present in the coating at a ratio (b):(c) of at least 1:1 by weight.

2. An ink jet recording sheet according to claim 1 wherein the ratio of (b):(c) is in the range of about 6:4 to about 4:1.

3. An ink jet recording sheet according to claim 1 wherein the colloidal silica comprises at least 0.16% by weight ammonia ($NH_3$).

4. An ink jet recording sheet according to claim 1 wherein the silica solids to alkali metal ratio is at least the sum of −0.30SSA+207.

5. An ink jet recording sheet according to claim 4 wherein the alkali metal is sodium.

6. An ink jet recording sheet according to claim 1 wherein the colloidal silica has a solids to alkali ion ratio of at least 150.

7. An ink jet recording sheet according to claim 1 wherein the colloidal silica has an average particle size in the range of about 1 to about 300 nanometers.

8. An ink jet recording sheet comprising a support and at least one coating layer thereon, said at least one coating layer (a) having a specular surface gloss of at least 30 at 60°, (b) comprising colloidal silica having a silica solids to alkali metal ratio of at least the sum of AW(−0.013*SSA+9), wherein SSA is the specific surface area of the colloidal silica, and (c) binder, wherein the colloidal silica and binder solids are present at a ratio (b):(c) of at least 1:1 by weight, and wherein the colloidal silica has a particle size distribution such that the median particle size is in the range of 15–100 nm and 80% of the particle sizes span a range of at least about 30 to about 70 nanometers.

9. An ink jet recording sheet according to claim 8 wherein the colloidal silica further comprises ammonia.

10. An ink jet recording sheet according to claim 8 wherein the colloidal silica has a silica solids to alkali metal ratio of at least the sum of −0.30(SSA)+207.

11. An ink jet recording sheet according to claim 10 wherein the alkali metal is sodium.

12. An ink jet recording sheet according to claim 8 wherein the colloidal silica has a solids to alkali ion ratio of at least 150.

13. A coating composition comprising (a) colloidal silica having a silica solids to alkali metal ratio of at least the sum of AW(−0.013SSA+9) wherein SSA is the colloidal silica's surface area, and AW is the atomic weight of the alkali metal; and (b) binder wherein (a) and (b) are present at a solids ratio of at least 1:1 by weight, and wherein the colloidal silica has a particle size distribution such that the median particle size is in the range of 15–100 nm and 80% of the particle sizes span a range of at least about 30 to about 70 nanometers.

14. A coating composition according to claim 13 wherein the solids ratio of (a) to (b) is in the range of about 6:4 to about 4:1.

15. A coating composition according to claim 13 wherein the colloidal silica contains at least 0.16% by weight ammonia.

16. A coating composition of claim 13 wherein the silica solids to alkali ratio is at least the sum of −0.30SSA+207.

17. A coating composition of claim 13 wherein the solids to alkali ratio is at least 150.

18. A coating composition comprising (a) comprising colloidal silica comprising ammonia and a silica solids to alkali ion ratio of at least the sum of AW(−0.013SSA+9) wherein SSA is the colloidal silica's surface area and AW is the atomic weight of the alkali metal; and (b) binder wherein (a) and (b) are present at a solids ratio of at least 1:1 by weight.

* * * * *